US011591146B2

(12) United States Patent
Jian et al.

(10) Patent No.: US 11,591,146 B2
(45) Date of Patent: Feb. 28, 2023

(54) CONTAINER WITH LID LOCKING DEVICE

(71) Applicant: SHANGHAI HONGYAN RETURNABLE TRANSIT PACKAGINGS CO., LTD., Shanghai (CN)

(72) Inventors: Yuan Li Jian, Shanghai (CN); Yi Wen Cao, Shanghai (CN)

(73) Assignee: SHANGHAI HONGYAN RETURNABLE TRANSIT PACKAGINGS CO., LTD., Shanghai (CN)

( * ) Notice: Subject to any disclaimer, the term of this patent is extended or adjusted under 35 U.S.C. 154(b) by 301 days.

(21) Appl. No.: 16/968,092

(22) PCT Filed: Jan. 4, 2019

(86) PCT No.: PCT/CN2019/070449

§ 371 (c)(1),
(2) Date: Aug. 6, 2020

(87) PCT Pub. No.: WO2019/153991

PCT Pub. Date: Aug. 15, 2019

(65) Prior Publication Data

US 2021/0024262 A1 Jan. 28, 2021

(30) Foreign Application Priority Data

Feb. 9, 2018 (CN) ..... 201810135815.9

(51) Int. Cl.
*B65D 55/02* (2006.01)
*B65D 19/06* (2006.01)

(52) U.S. Cl.
CPC ..... *B65D 55/02* (2013.01); *B65D 19/06* (2013.01); *B65D 2255/20* (2013.01); *B65D 2519/00706* (2013.01)

(58) Field of Classification Search
CPC ..... B65D 55/02; B65D 2255/20; B65D 2519/00706; E05C 1/00; E05C 1/145; E05C 1/14; E05C 1/12; E05C 1/08; E05B 83/02
See application file for complete search history.

(56) References Cited

U.S. PATENT DOCUMENTS 3,979,016 A 9/1976 Frater
2018/0086520 A1* 3/2018 Jian ..... B65D 55/02

FOREIGN PATENT DOCUMENTS

CN 104590787 A 5/2015
CN 104960813 A 10/2015
(Continued)

OTHER PUBLICATIONS

International Search Report (with English translation) and Written Opinion published in PCT/CN2019/070449, dated Mar. 27, 2019, 11 pages provided.

(Continued)

*Primary Examiner* — Javier A Pagan
(74) *Attorney, Agent, or Firm* — Hamre, Schumann, Mueller & Larson, P.C.

(57) ABSTRACT

This application discloses a container. The container comprises a base, two pairs of opposite side plates and a lid. The two pairs of opposite side plates are both connected to the base. The lid can be locked to the top of the side plate via a locking device. Each of the four top corners of the container is provided with one locking device. The four locking device are arranged opposite to each other tin pairs along the corresponding diagonal of the lid, and each of the locking device includes one locking tongue member provided on the lid and one locking groove provided on the corresponding side plate. The locking tongue member has a locking tongue and is arranged to be movable relative to the lid so that the locking tongue is insertable into the locking (Continued)

groove to lock the lid to the side plate and is detachable from the locking groove to unlock the lid. Each of the locking grooves extends outwardly from the side plate along the corresponding diagonal direction of the lid. The lid of the container of the present application can be unlocked from any direction.

19 Claims, 16 Drawing Sheets

(56) References Cited

FOREIGN PATENT DOCUMENTS

| | | | | | |
|---|---|---|---|---|---|
| CN | 108341124 | A | | 7/2018 | |
| CN | 208021945 | U | | 10/2018 | |
| EP | 2671812 | A1 | | 12/2013 | |
| JP | 2000226061 | A | | 8/2000 | |
| JP | 2002255174 | A | | 9/2002 | |
| JP | 2005225538 | A | | 8/2005 | |
| JP | 2009202899 | A | | 9/2009 | |
| JP | 2015151136 | A | | 8/2015 | |
| JP | 2015151136 | A | * | 8/2015 | ..... B65D 88/025 |
| JP | 2017065688 | A | * | 4/2017 | |
| JP | 2017065688 | A | | 4/2017 | |
| WO | 2016112862 | A1 | | 7/2016 | |
| WO | 2016206586 | A1 | | 12/2016 | |
| WO | 2018019209 | A1 | | 2/2018 | |
| WO | WO-2018019209 | A1 | * | 2/2018 | ..... B65D 19/04 |

OTHER PUBLICATIONS

Examination Report issued in corresponding Australian Application No. 2019217855, dated May 21, 2021.

Examination Report issued in corresponding Australian Application No. 2019217855, dated Nov. 25, 2021.

Notice of Reasons for Refusal issued in corresponding Japanese Application No. 2020-542591, dated Jul. 9, 2021, with machine translation.

* cited by examiner

CONTAINER WITH LID LOCKING DEVICE

CROSS-REFERENCE OF RELATED APPLICATION

This application claims the priorities of Chinese patent application No. 201810135815.9, entitled "Container", filed on Feb. 9, 2018, the entire disclosure thereof is incorporated herein by reference.

TECHNICAL FIELD

The present invention relates to a logistics transportation field, and in particular to a container.

BACKGROUND OF THE INVENTION

In some industries, it is a conventional method to use large containers made of composite materials to package, transport and store goods. Most of these containers have plastic side plates and bottoms, and pipes made by metal are placed in the side plates and bottoms for reinforcement. When liquid goods need to be contained, a liner bag can be used to be laid out in a container body, and then the liquid goods can be filled into the liner bag. When the liquid goods are filled, a lid is generally placed on the container to protect the liquid goods in the container body and prevent rain, dust, etc. from contaminating the liquid goods. In addition, regardless of whether the container has a foldable or non-foldable structure, the lid connected to the container body can always provide a considerable support to the overall strength. When the container is filled with liquid goods, with the bumped, suddenly accelerating and decelerating situations during transportation, the liquid fluctuates violently in the container. At this time, the lid can effectively reduce the amplitude of liquid fluctuations, so that the liner bag will not be broken due to excessive load, and the safety of the liquid goods is guaranteed. Also, the effect of the lid on the large-sized container is that when two containers are stacked each other, the lid can limit the horizontal movement of the upper container in all directions, so that the upper container will not easily fall over. At present, most of container lids have 4-8 manually operated lid locks, which have horizontal latches to connect the lid to the container body. The lid with such structural solution meets the functional requirements of the container to a certain extent, but the lock is inconvenient to use and easy to damage.

CN 104590787A discloses a novel lid locking structure with elastic reset, which improves the inconvenience of lid locking in the above solution, and the operation is relatively simple, but the structure can still only be unlocked from a specific side.

SUMMARY OF THE INVENTION

The object of the present invention is to provide a container capable of unlocking the lid of the container from any side.

In order to achieve the above object, the present invention provides a container, comprising a base, two pairs of opposed side plates and a lid, wherein the two pairs of opposed side plates are both connected to the base, and the lid is lockable to the top of the side plates via locking devices, each of four top corners of the container is provided with one locking device, wherein four locking devices are arranged opposite to each other in pairs along the corresponding diagonal of the lid, and each of the locking device includes one locking tongue member provided on the lid and one locking groove provided on the corresponding side plate, wherein the locking tongue member has a locking tongue and is arranged to be movable relative to the lid so that the locking tongue is insertable into the locking groove to lock the lid to the side plate and is detachable from the locking groove to unlock the lid, and each of the locking grooves extends outwardly out of the side plate along the corresponding diagonal direction of the lid.

Preferably, each corner of the container is provided with one protrusion protruding upwardly from the lid, all the protrusions have the same outer shape and the shape of each protrusion is symmetrical with respect to the corresponding diagonal of the lid, the locking device is mounted in the protrusion, and the four corners of the base of the container are provided with pits whose positions and shapes match with the positions and shapes of the protrusions respectively.

Preferably, the protrusion integrally protrudes upwardly from the lid.

Preferably, the locking device further has an operating member and a restoring member, wherein the operating member is slidably mounted on the lid and connected to the locking tongue member, and the restoring member is arranged to reset the locking tongue member after releasing the operating member.

Preferably, the locking tongue member has a rod-shaped body, a vertical rod extends downwardly from one end of the rod-shaped body, a locking tongue extends from a distal end of the vertical rod toward the other end of the rod-shaped body in a direction parallel to the rod-shaped body.

Preferably, the operating member has a plate-shaped body, one end of the plate-shaped body is provided with a recessed operating portion and the other end is provided with side walls extending downwardly on both sides, the lower edge of the side wall is provided with a guiding rail, which is slidably mounted in the lid, and the middle portion of the plate-shaped body extends downwardly out of a mounting post; and the rod-shaped body of the locking tongue member is provided with a mounting hole where the mounting post is inserted.

The present invention also provides a container, comprising a base, two pairs of opposed side plates and a lid, wherein the two pairs of opposed side plates are both connected to the base, and the lid is lockable to the side plate via locking devices, each of four top corners of the container is provided with one locking device, wherein each of the locking device includes one locking tongue member provided on the lid and one locking groove provided on the corresponding side plate, wherein the locking tongue member has a locking tongue and is arranged to be movable relative to the lid so that the locking tongue is insertable into the locking groove to lock the lid to the side plate and is detachable from the locking groove to unlock the lid, and each of two ends of the upper portion of each side plate of one pair of the two pairs of opposite side plates is provided with one locking groove, wherein the locking groove is a recess, one end of the recess is at a predetermined distance from the edge of the side plate and the other end extends out of the side plate along a direction parallel to the lid, and unlocking directions of the two locking devices arranged on the same side of one of the pair of opposite side plates provided with the locking grooves are the same, and the unlocking directions are opposite to unlocking directions of the two locking devices arranged on the same side of the other one of the pair of opposite side plates.

Preferably, each corner of the container is provided with one protrusion protruding upwardly from the lid, all the protrusions have the same outer shape and the shape of each protrusion is symmetrical with respect to the corresponding diagonal of the lid, the locking device is mounted in the protrusion, and the four corners of the base of the container are provided with pits whose the positions and shapes match with the positions and shapes of the protrusions respectively.

Preferably, the protrusion integrally protrudes upwardly from the lid.

Preferably, the locking device further has an operating member and a restoring member, wherein the operating member is slidably mounted on the lid and connected to the locking tongue member, and the restoring member is arranged to reset the locking tongue member after releasing the operating member.

Preferably, the locking tongue member has a rod-shaped body, a vertical rod extends downwardly from one end of the rod-shaped body, a locking tongue extends from a distal end of the vertical rod toward the other end of the rod-shaped body in a direction parallel to the rod-shaped body.

Preferably, the operating member has a plate-shaped body, one end of the plate-shaped body is provided with a recessed operating portion and the other end is provided with side walls extending downwardly on both sides, the lower edge of the side wall is provided with a guiding rail which is slidably mounted in the lid, and a mounting post extends downwardly from the middle portion of the plate-shaped body; and the rod-shaped body of the locking tongue member is provided with a mounting hole where the mounting post is inserted.

The present invention further provides a container, comprising a base, two pairs of opposed side plates and a lid, wherein the two pairs of opposed side plates are both connected to the base, and the lid is lockable to the side plate via locking devices, each of four top corners of the container is provided with one locking device, wherein each of the locking device includes one locking tongue member provided on the lid and one locking groove provided on the corresponding side plate, wherein the locking tongue member has a locking tongue and is arranged to be movable relative to the lid so that the locking tongue is insertable into the locking groove to lock the lid to the side plate and is detachable from the locking groove to unlock the lid, each of two ends of the upper portion of each side plate of one pair of the two pairs of opposite side plates is provided with one locking groove, the locking grooves are recesses provided on the two ends of the upper portion of the side plate respectively, one end of the recess is at a predetermined distance from the edge of the side plate and the other end is provided with a guiding slope, and the unlocking directions of the two locking devices arranged on the same side of one of the pair of opposite side plates are the same, and the unlocking directions are opposite to the unlocking directions of the two locking devices arranged on the same side of the other one of the pair of opposite side plates.

Preferably, each corner of the container is provided with one protrusion protruding upwardly from the lid, all the protrusions have the same outer shape and the shape of each protrusion is symmetrical with respect to the corresponding diagonal of the lid, the locking device is mounted in the protrusion, and the four corners of the base of the container are provided with pits whose the positions and shapes match with the positions and shapes of the protrusions respectively.

Preferably, the protrusion integrally protrudes upwardly from the lid.

Preferably, the locking device further has an operating member and a restoring member, wherein the operating member is slidably mounted on the lid and connected to the locking tongue member, and the restoring member is arranged to reset the locking tongue member after releasing the operating member.

Preferably, the locking tongue member has a rod-shaped body, a vertical rod extends downwardly from one end of the rod-shaped body, a locking tongue extends from the end of the vertical rod toward the other end of the rod-shaped body in a direction parallel to the rod-shaped body.

Preferably, the operating member has a plate-shaped body, one end of the plate-shaped body is provided with a recessed operating portion and the other end is provided with side walls extending downwardly on both sides, the lower edge of the side wall is provided with a guiding rail, which is slidably mounted in the lid, and a mounting post extends downwardly from the middle portion of the plate-shaped body ; and the rod-shaped body of the locking tongue member is provided with a mounting hole where the mounting post is inserted.

Preferably, each of the aforementioned containers is a container with a length more than 800 mm, a width more than 600 mm, and a height more than 500 mm. For example, the aforementioned container is an IBC container.

The container of the present invention has the following beneficial effects:

1. The lid of the container can be unlocked from any side, that is, the so-called four-way unlocking is realized.

2. For containers with a square lid, it is allowed to buckle the lid and side plate from any side, and allow the upper container to be stacked on the lower container from any side when stacking.

THE DETAILED DESCRIPTIONS OF EMBODIMENTS

The preferred embodiments of the present invention will be described in detail below with reference to the accompanying drawings, so that the purposes, features and advantages of the present invention can be more clearly understood. It should be understood that the embodiments shown in the accompanying drawings are not intended to limit the scope of the present invention, and is only used for illustrating the essential spirit of the technical solution of the present invention.

In the following description, for the purpose of illustrating various disclosed embodiments, some specific details are set forth to provide a thorough understanding of various disclosed embodiments. However, those skilled in the relevant art will recognize that the embodiments may be embodied without one or more of these specific details. In other situations, well-known devices, structures, and technologies associated with the present application may not be shown or described in detail to avoid unnecessarily obscuring the description of the embodiments.

Unless the context has other requirement, throughout the specification and claims, the words "comprising" and its variations, such as "including" and "having" should be understood as open and inclusive meanings, that is, should be interpreted as "including, but not limited to".

Throughout the specification, reference to "one embodiment" or "an embodiment" means that a specific feature, structure, or characteristic described in combination with the embodiment is involved in at least one embodiment. Therefore, the appearances of "in one embodiment" or "in an embodiment" in various positions throughout the specification are not all refer to the same embodiment. In addition, specific features, structures, or characteristics may be combined in any manner in one or more embodiments.

As used in this specification and the appended claims, the singular forms "a" and "the" include plural referents unless the context clearly dictates otherwise. It should be noted that the term "or" is usually used in its meaning including "and/or", unless the context clearly stipulates otherwise.

In the following description, in order to clearly demonstrate the structure and working mode of the present invention, many directional words will be used for description, but the words "front", "rear", "left", "right", "outer", "inner" , "outward", "inward", "upper", "lower" and other words should be understood as convenient terms and should not be understood as restrictive terms.

Figure 1:
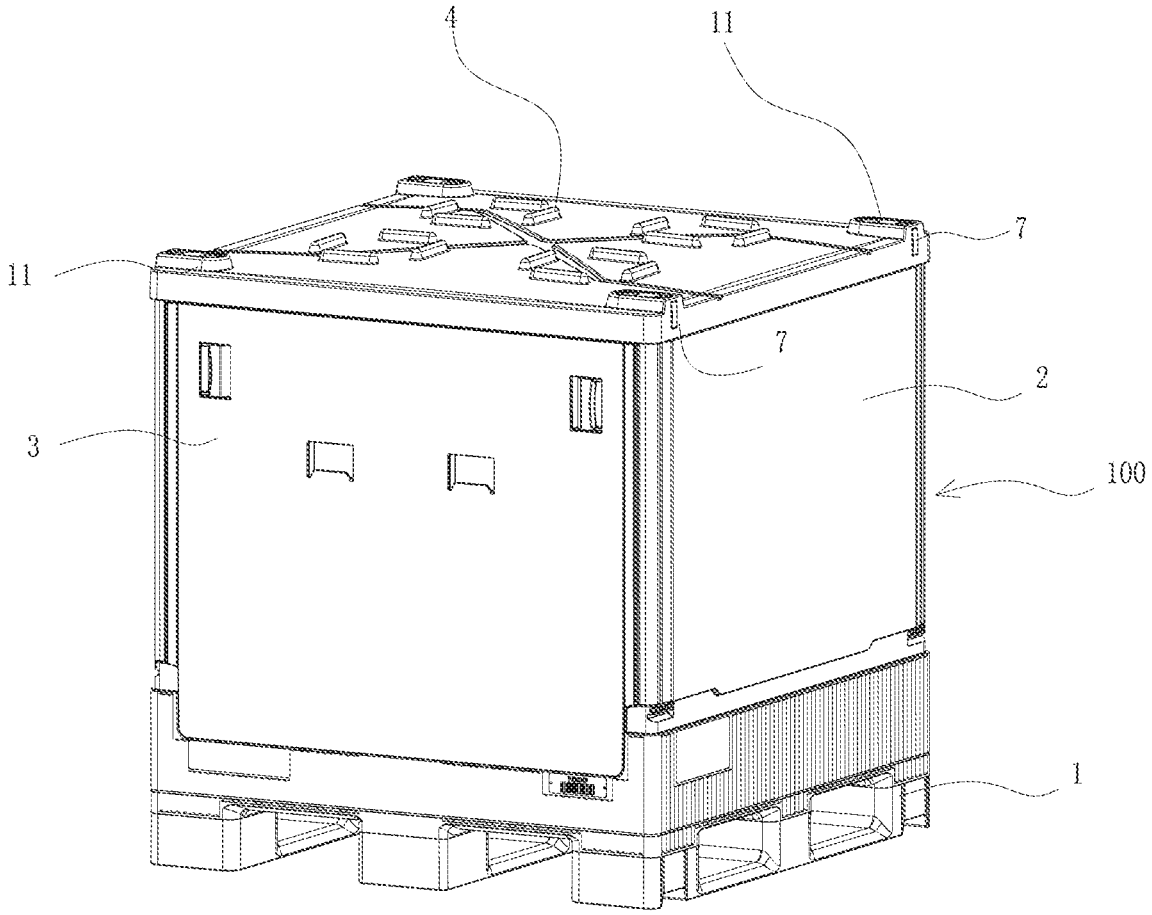
FIG. 1 is a perspective view of the structure of a container provided with a locking device of the present invention.

FIG. 1 is a container 100 provided with a locking device according to one embodiment of the present invention. The container 100 includes a base 1, two pairs of opposite side plates 2 and 3, and a lid 4. Two pairs of opposite side plates are connected to the base 1. In this embodiment, all of the four side plates can be foldably connected to the base 1. Adjacent side plates are engaged with each other through an engaging structure. A small door 5 and a handle 6 are provided on one pair of opposite side plates 3 of the two pairs of opposite side plates. The small door 5 can be opened so as to obtain goods within the container. The handle 6 facilitates the operation of the side plate of the container. The lid 4 can be locked to the top of the side plate via a locking device 7. Each of the four corners of the container 100 is provided with one locking device 7. In this embodiment, each corner of the container 100 is provided with a protrusion 11 integrally protruding upward from the lid 4. The locking device 7 is mounted in the protrusion 11.

The locking device 7 herein is particularly suitable for large container, such as IBC container. Such a large container has a relatively large size, and generally, it is usually difficult for a person to operate the locking device on the opposite side when standing on one side of the container. Such containers generally has a length more than 800 mm, a width more than 600 mm and a height more than 500 mm.

Figure 2:
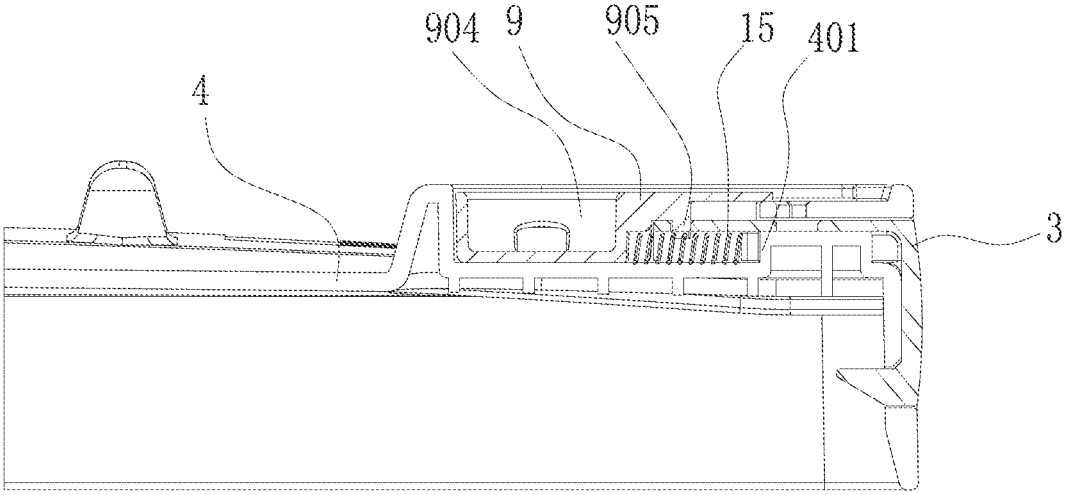
FIG. 2 is a cross-sectional view of the lid of FIG. 1 and the locking device thereon.
Figure 3:
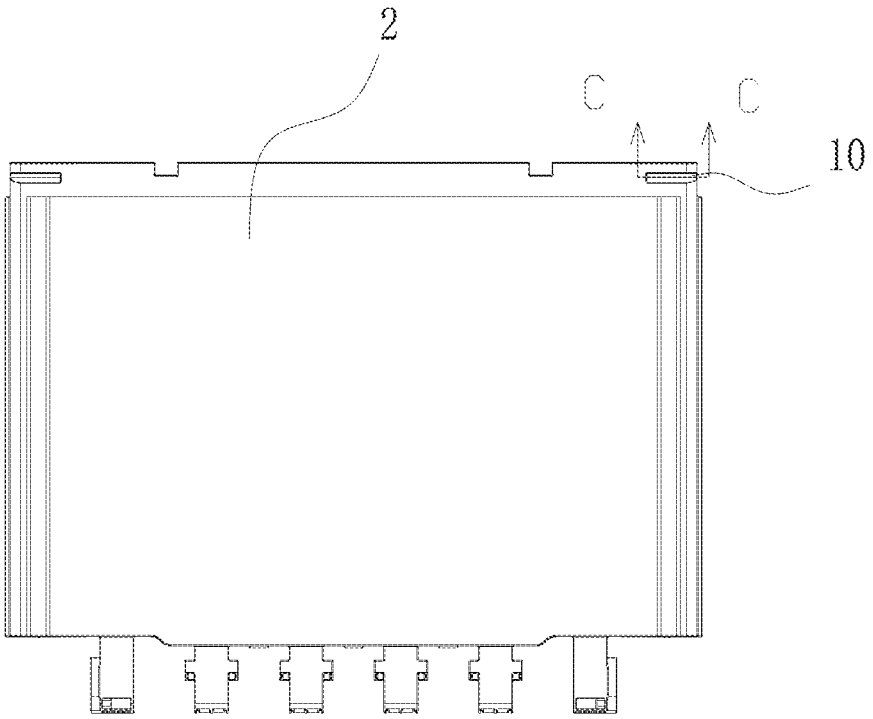
FIG. 3 is a front view of the side plate provided with a locking groove of FIG. 1.
Figure 4:
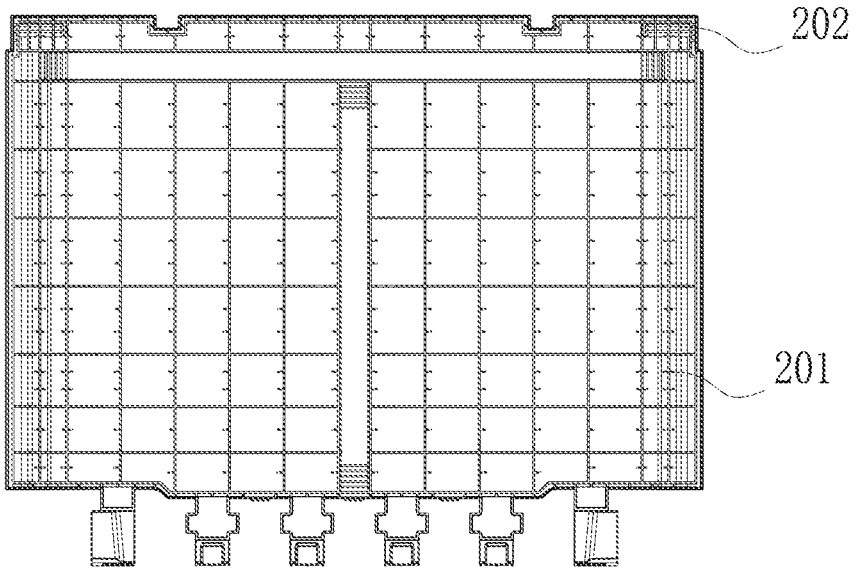
FIG. 4 is a view of the structure of an outer plate of the side plate of FIG. 3.

As shown in FIGS. 2 to 4, the locking device 7 includes a locking tongue member 8, an operating member 9 provided on the lid and a locking groove 10 provided on the corresponding side plate. Each of the two ends of upper portion of each side plate 2 of one pair of opposite side plates is provided with one locking groove 10. The locking tongue member 8 is arranged to be able to move relative to the lid 1 under the operation of the operating member 9. The locking tongue member 8 and the locking groove 10 are configured such that the locking tongue member 8 can be inserted into the locking groove 10 to lock the lid 4 to the side plate 2, and after unlocking the two locking device 7 on this side from any side of the lid 1 at the same time, the lid 1 can be removed from the side plate. Here, unlocking is usually achieved by moving the locking tongue member 8 outward relative to the side plate.

In the embodiment shown in the figures, the small door 5 and the handle 6 are arranged on the first pair of opposite side plates 3 of the container 100. The locking groove 10 is arranged on the second pair of opposite side plates 2 of the container. The unlocking direction of the two locking device arranged on the same side of one side plate of the second pair of opposite side plates 2 of the container 100 is the same, that is, they move in the same direction to realize unlocking. The unlocking direction of the two locking device arranged on the same side of one side plate of the second pair of opposite side plates 2 of the container 100 is opposite to the unlocking direction of the two locking device arranged on the same side of the other side plate of the second pair of opposite side plates.

Figure 6:
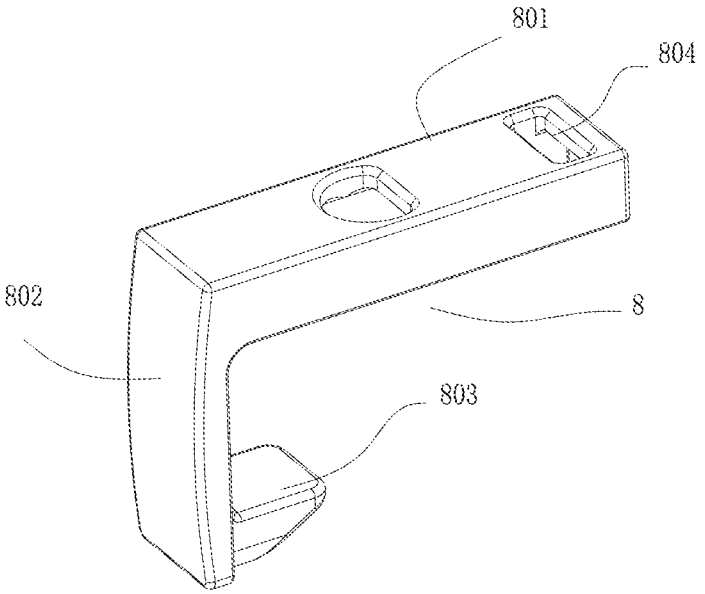
FIG. 6 is a perspective view of a locking tongue member that cooperates with the operating member of FIG. 5.
Figure 6A:
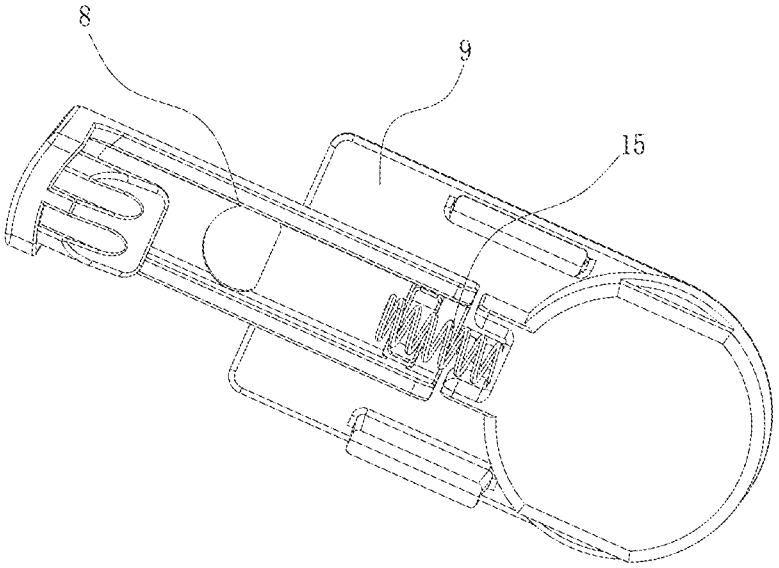
FIG. 6A is an assembly view of the aforementioned locking device.
Figure 6B:
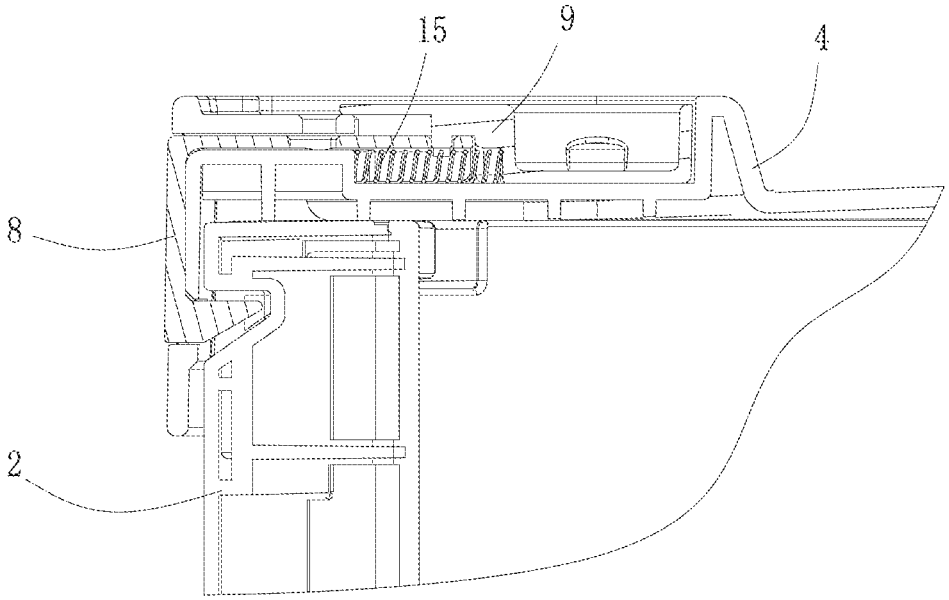
FIG. 6B is a partial cross-sectional view of the locked portion when the lid is in a locked state.
Figure 6C:
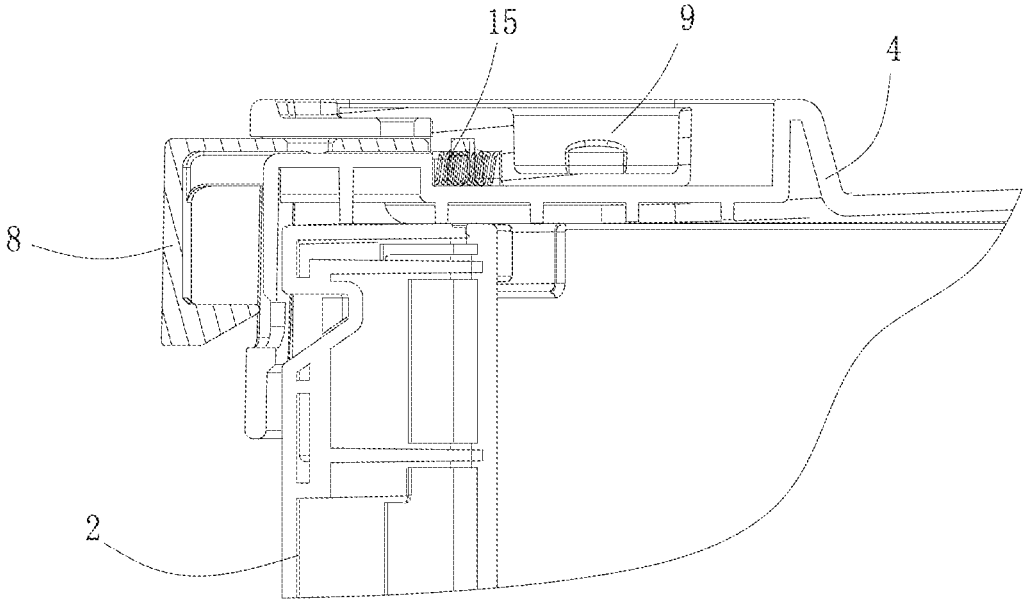
FIG. 6C is a partial cross-sectional view of the locked portion when the lid is in an unlocked state.
Figure 6D:
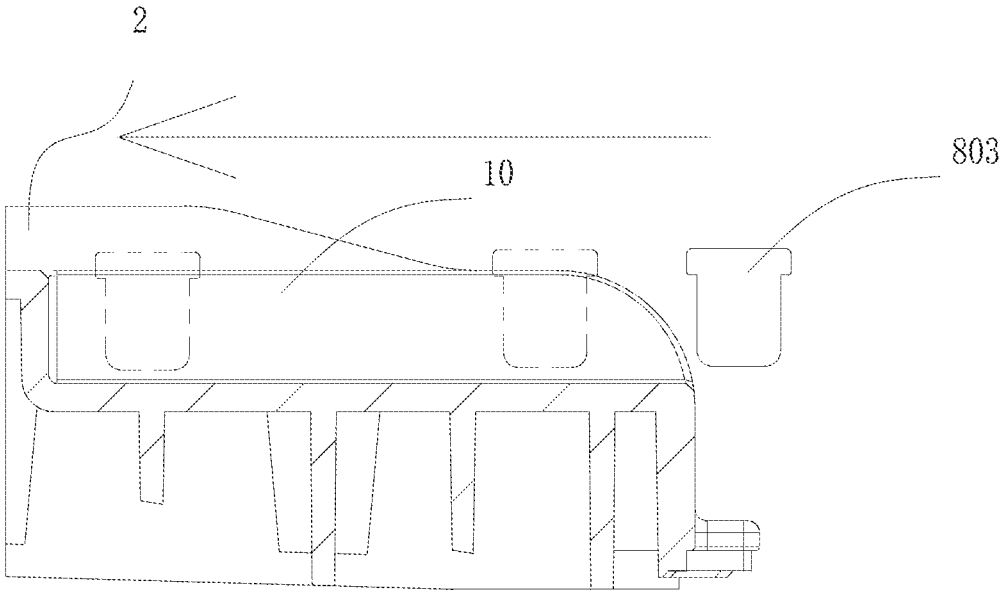
FIG. 6D is a partially enlarged sectional view taken along the line C-C of FIG. 3, and schematically shows the movement track of the locking tongue.

Referring to FIGS. 3-4 and FIG. 6D, the locking groove 10 on the side plate 2 is a recess. The recess starts at a predetermined distance from an edge of the side plate and extends out of the edge of the side plate in a direction parallel to the lid 4. That is, the end of the locking groove 10 is open. Preferably, the length of the locking groove is 2 mm~10 mm. More preferably, the length of the lock groove is 3 mm~8 mm.

In this embodiment, the side plate 2 is formed by welding an inner plate and an outer plate with each other. The outer surface of the outer plate 201 is smooth, and the inner surface is provided with reinforcing ribs. The locking groove 10 is arranged on the outer surface of the outer plate 201. Reinforcing ribs 202 are provided at positions in the side plate corresponding to the position where the locking groove 10 is provided, and the distribution density of the reinforcing ribs 202 is more than the distribution density of the reinforcing ribs in the rest of the side plate.

Figure 5:
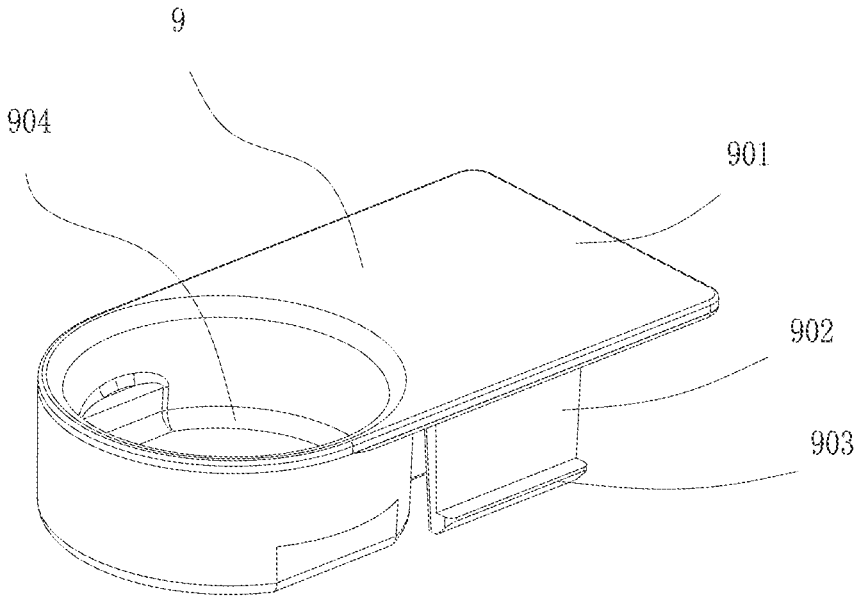
FIG. 5 is a perspective view of an operating member of a locking device according to one embodiment of the present invention.
Figure 5A:
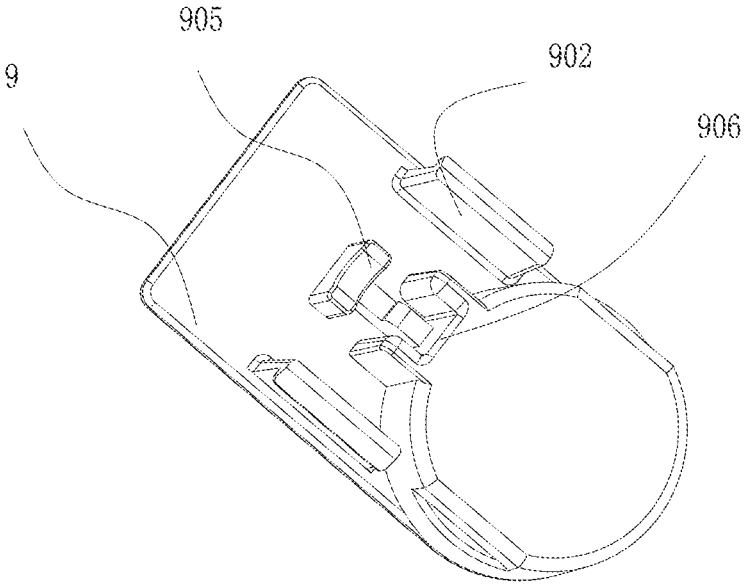
FIG. 5A is another perspective view of the operating member of FIG. 5.

See FIGS. 2 and 5-6, the operating member 9 of the locking device 7 has a plate-shaped body 901. One end of the plate-shaped body 901 is provided with an operating portion 904 recessed from the upper surface. Side walls 902 extend downwardly on both sides of the other end of the plate-shaped body 901. The lower edge of the side wall 902 is provided with a guiding rail 903. The guiding rail 903 is slidably mounted in the lid 4. A mounting post 905 extends downwardly from the middle portion of the plate-shaped body 901. A stop 906 also extends from the bottom surface of the plate-shaped body.

See FIG. 6, the locking tongue member 8 has a rod-shaped body 801. A vertical rod 802 extends downwardly from one end of the rod-shaped body 801. A locking tongue 803 extends from the end of the vertical rod 802 toward the other end of the rod-shaped body 801 in a direction parallel to the rod-shaped body 801. The rod-shaped body 801 is provided with a mounting hole 804. The mounting post 905 of the operating member 9 is inserted into the mounting hole 804 to connect the operating member 9 and the locking tongue member 8 to each other.

The locking device 7 further has a restoring member 15 which is arranged to reset the locking tongue member 8 after releasing the operating member 9, that is, to keep the locking tongue member in a retracted state. Specifically, in this embodiment, the restoring member is a spring 15. As shown in FIGS. 6B and 6C, the spring 15 is accommodated in the lid 4. One end of the spring abuts against the stop 906 of the operating member and the other end abuts against a baffle 401 in the lid. Thus, as shown in FIG. 6C, when unlocking, the spring 15 is compressed so as to provide a restoring force. After the operator releases his hand, the spring 15 restores and drives the operating member 9 to reset, and the operating member 9 drives the locking tongue member 8 to reset, so that the locking device is in the locked state again, as shown in FIG. 6B.

Figure 7:
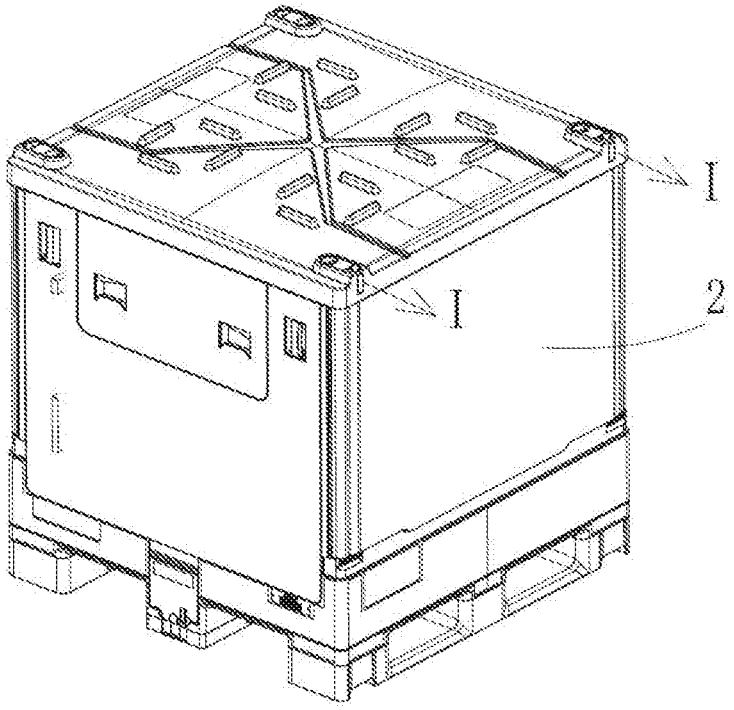
FIGS. 7 and 8 are schematic diagrams of unlocking the lid in the first unlocking direction.
Figure 8:
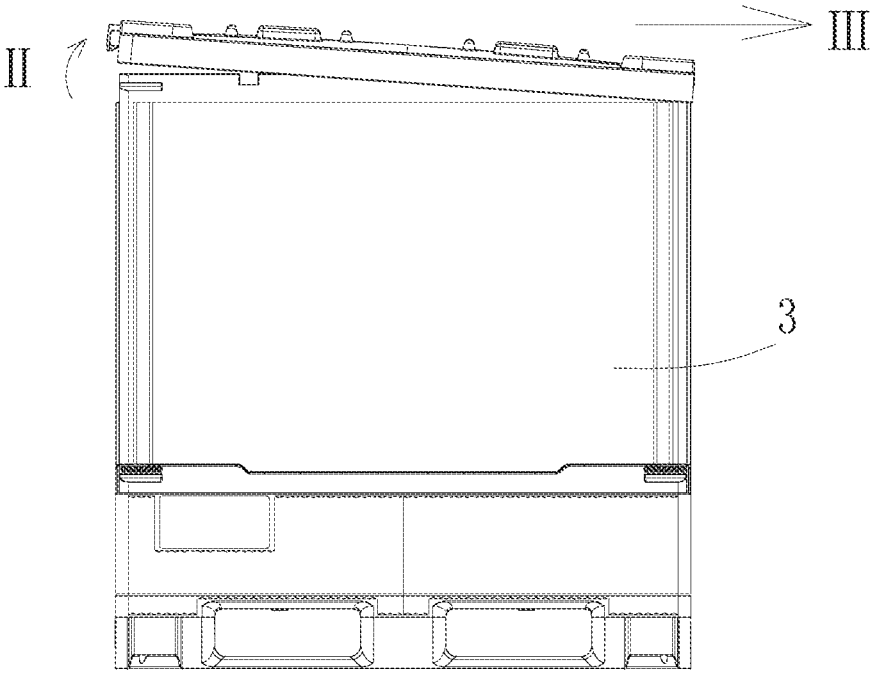

FIGS. 7 and 8 are schematic diagrams of unlocking the lid in the first unlocking direction. As shown in FIG. 7-8, when the operator stands on the side of the side plate 2 to unlock the lid, firstly, the two locking device 7 on this side are unlocked at the same time, that is, the locking tongues of the two locking device 7 are pulled out toward the same direction. Then, the lid 4 is push toward the opposite side plate, so as to unlock the lid. When the operator stands on the side of a side plate opposite to the side plate 2 to unlock the lid, the operating mode is the same.

Figure 9:
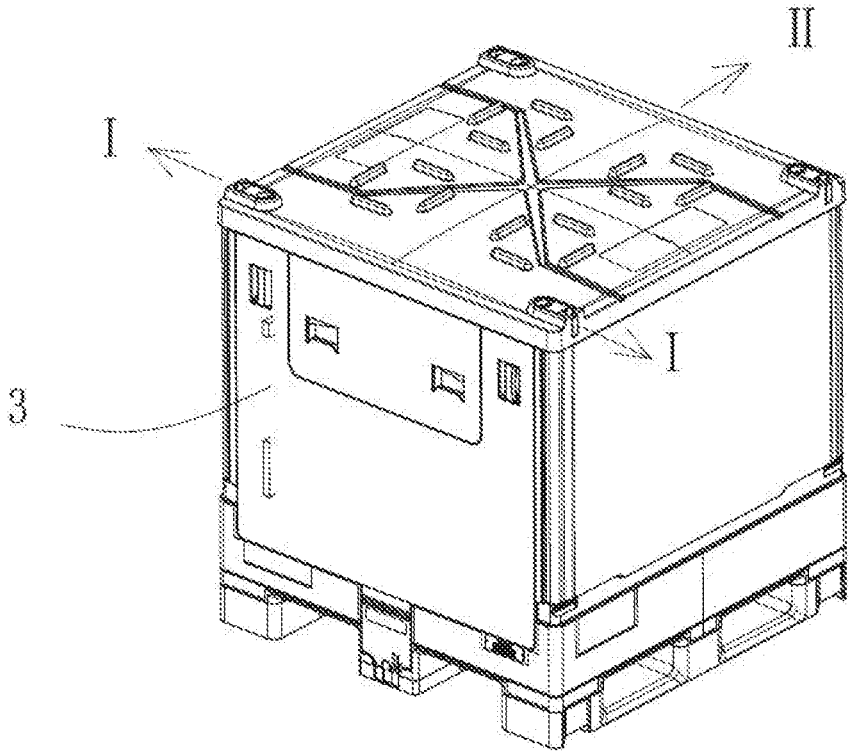
FIGS. 9 and 10 are schematic diagrams of unlocking the lid in the second unlocking direction.
Figure 10:
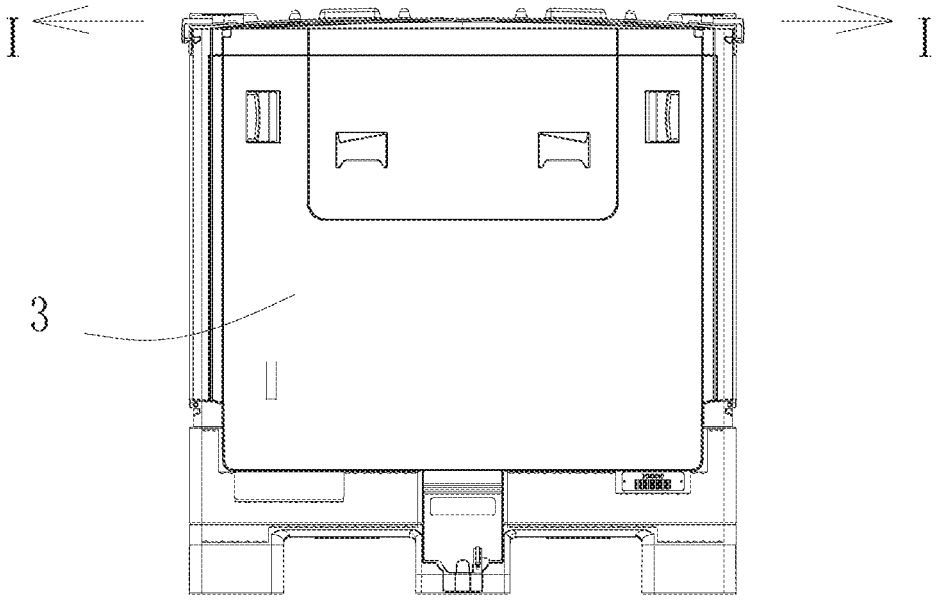

FIGS. 9 and 10 are schematic diagrams of unlocking the lid in the second unlocking direction. As shown in FIG. 9-10, when the operator stands on the side of the side plate 3 to unlock the lid, firstly, the two locking device 7 on this side are unlocked at the same time, that is, the locking tongues of the two locking device 7 are pulled out in opposite directions. Then, the lid 4 is push toward the opposite side plate, so as to unlock the lid. When the operator stands on the side of a side plate opposite to the side plate 3 to unlock the lid, the operating mode is the same.

As a result, the lid can be unlocked on the side where any side plate is located, that is, the so-called four-way unlocking can be realized.

Figure 11:
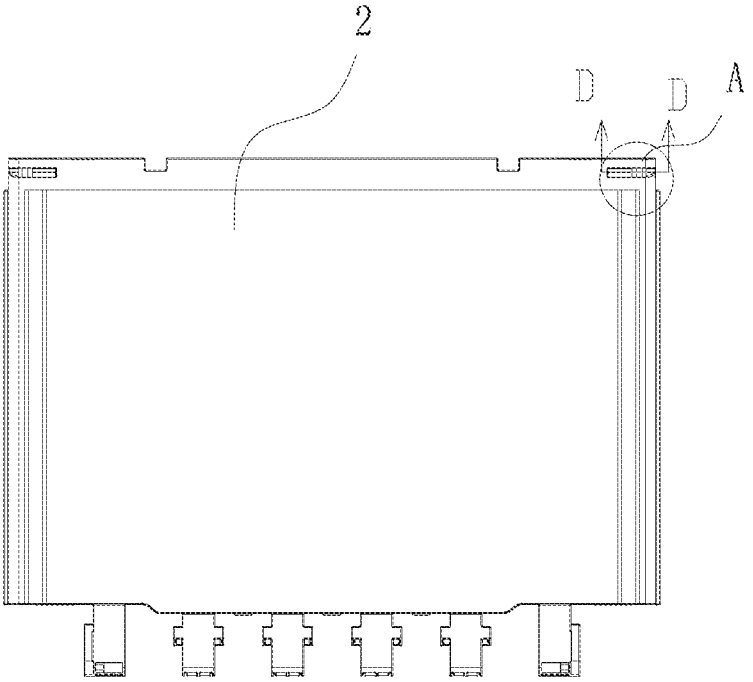
FIG. 11 is a front view of a side plate of a container provided with a locking device according to another embodiment of the present invention.
Figure 12:
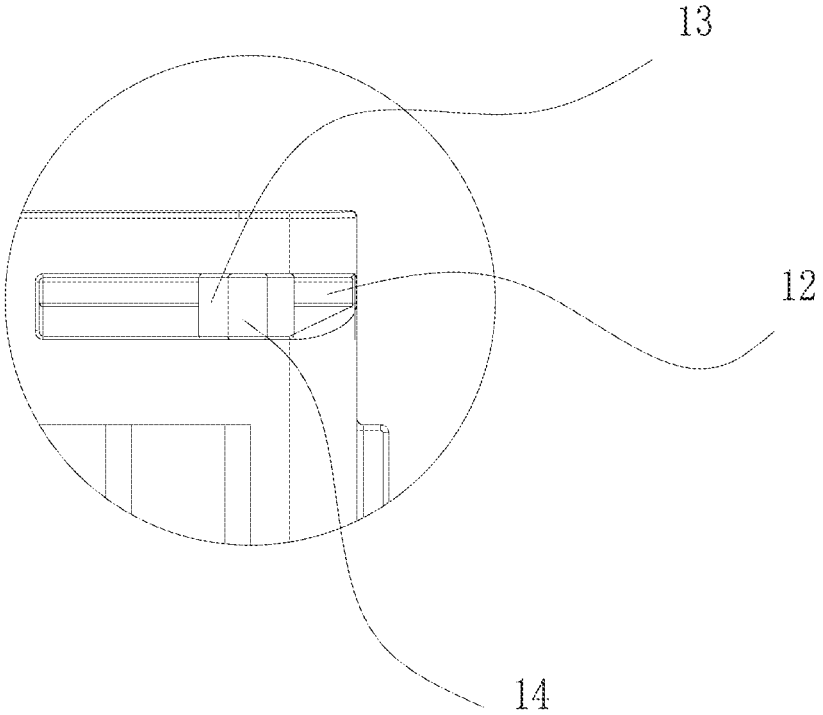
FIG. 12 is an enlarged view of part A in FIG. 11.
Figure 12A:
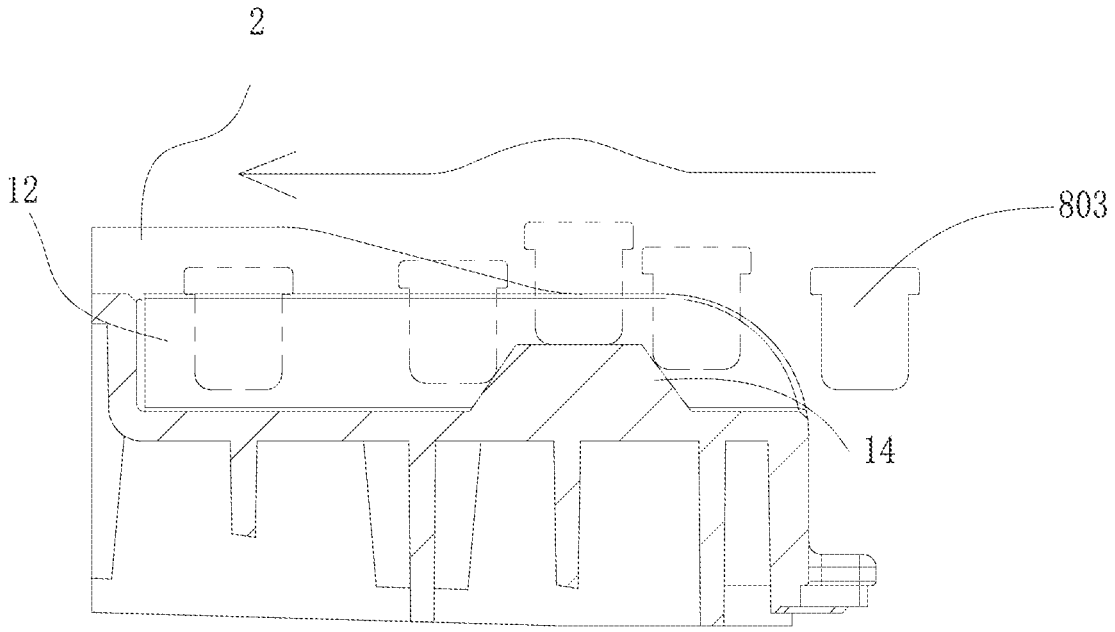
FIG. 12A is a partially enlarged sectional view taken along the line D-D of FIG. 3, and schematically shows the movement track of the locking tongue.

FIGS. 11-12 and 12A show the structure of the side plate of a container provided with a locking device according to another embodiment of the present invention. As shown in FIGS. 11-12, the difference between this embodiment and the foregoing embodiment is the shape of the locking groove on the side plate. In this embodiment, the locking grooves are recesses 12 provided at the two ends of the upper portion of the side plate. One end of the recess 12 is at a predetermined distance from the edge of the side plate. The recess 12 extends a distance toward the edge of the side plate in a direction parallel to the lid. A guiding portion 14 extends upwardly from the bottom of a part of the recess 12, and the guiding portion has a wedge shape with a wider bottom and a narrower top. The guiding portion 14 is provided with a guiding slope 13. The locking tongue 803 can move toward the outside of the side plate under the action of the guiding slope to realize the unlocking of the corresponding locking device. In this embodiment, the recess may or may not extend beyond the edge of the side plate, as long as a part of the groove, for example, the other end of the recess, is provided with a guiding slope.

FIGS. 13-20 show schematic structural views of a container 200 provided with a locking device according to another embodiment of the present invention. The difference between this embodiment and the above-mentioned embodiments mainly is the placement position of the locking device. The operating member and the locking tongue member of the locking device are the same as those of the above-mentioned embodiments, and will not be described in detail herein. In this embodiment, similarly, each of the four top corners of the container is provided with one locking device 16. The four locking devices 16 are arranged opposite to each other along the corresponding diagonal of the lid 17, and each locking device 16 includes one above-mentioned operating member 9, the above-mentioned locking tongue member 8 provided on the lid and one locking groove 18 provided on a corresponding side plate. The locking tongue member 8 has a locking tongue and is arranged to be movable relative to the lid 17 so that the locking tongue can be inserted into the locking groove to lock the lid to the side plate and can be disengaged from the locking groove to unlock the lid. Each locking groove 18 extends outwardly out of the side plate in the corresponding diagonal direction of the lid.

Figure 17:
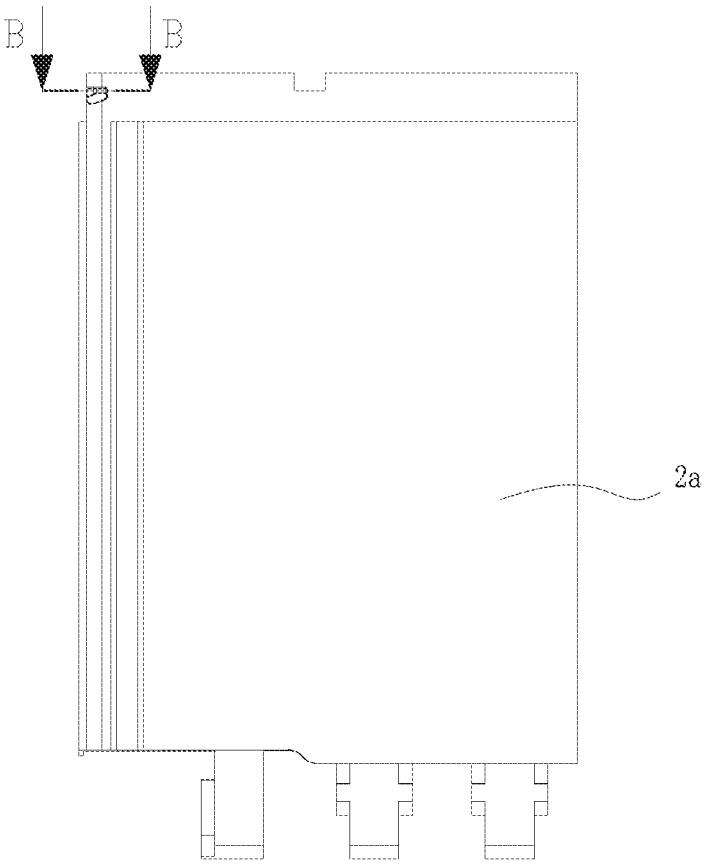
FIG. 17 is a side view of the container of FIG. 13.
Figure 18:
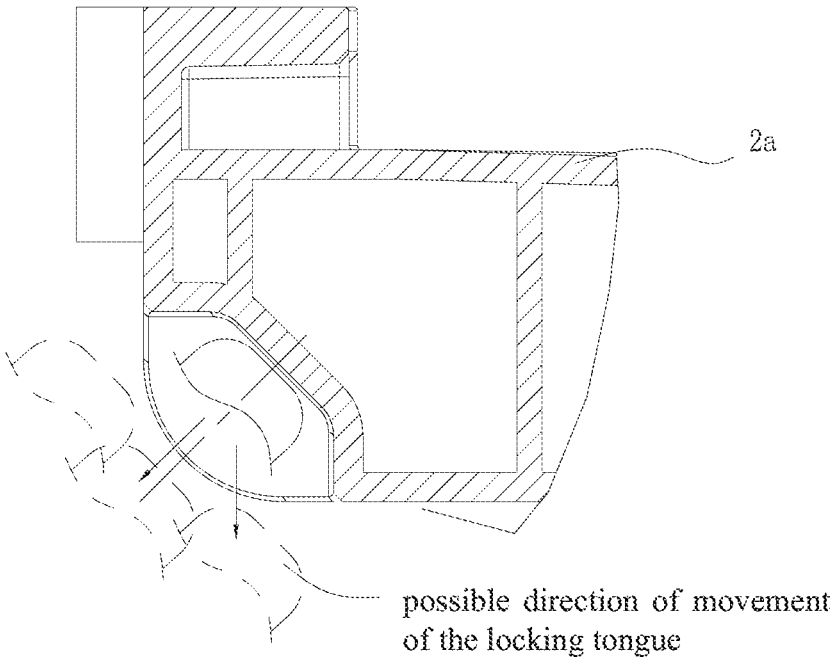
FIG. 18 is a partially enlarged sectional view taken along the line B-B of FIG. 17.

Each of the upper corners of the intersection of two adjacent side plates is provided with a locking groove 18. As shown in FIGS. 17-18, the lock groove 18 is arranged outside the corner of the side plate 2*a*. The width of the lock groove 18 should be wide enough so that after the two locking device at the opposite side plate are unlocked, when the lid is pushed toward the side plate 2*a*, the locking tongues of the two locking device on side of the side plate 2*a* can be disengaged from the locking groove 18. Further, each locking groove 18 is symmetrical with respect to the corresponding diagonal of the lid 17.

Figure 15:
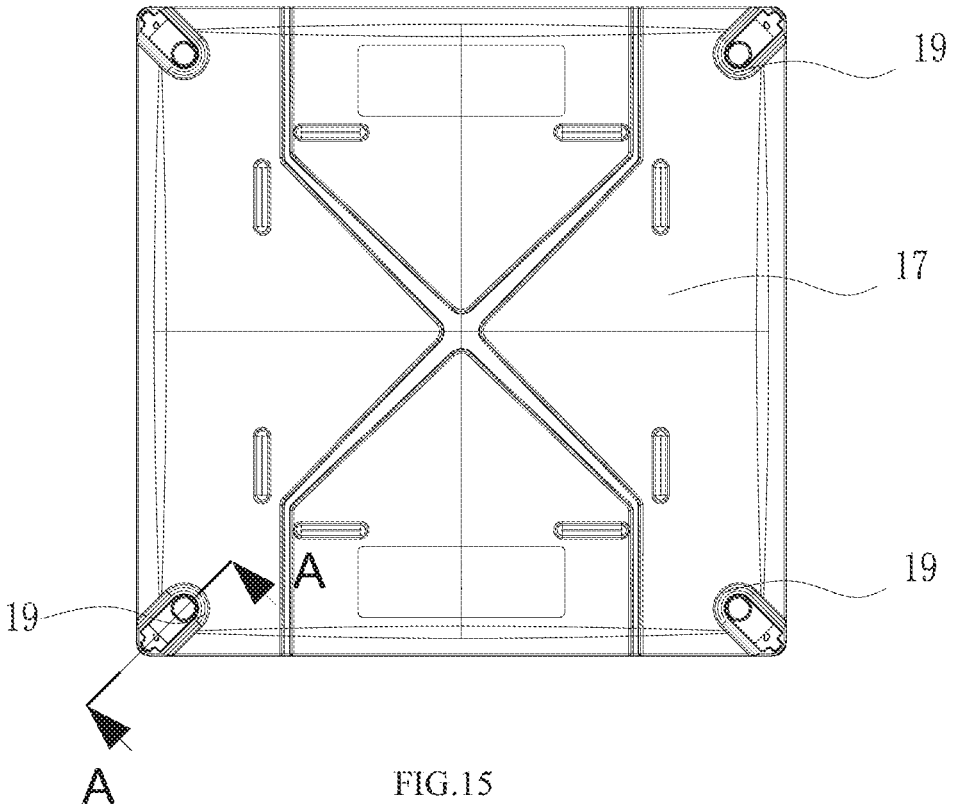
FIG. 15 is a top view of the container of FIG. 13.
Figure 16:
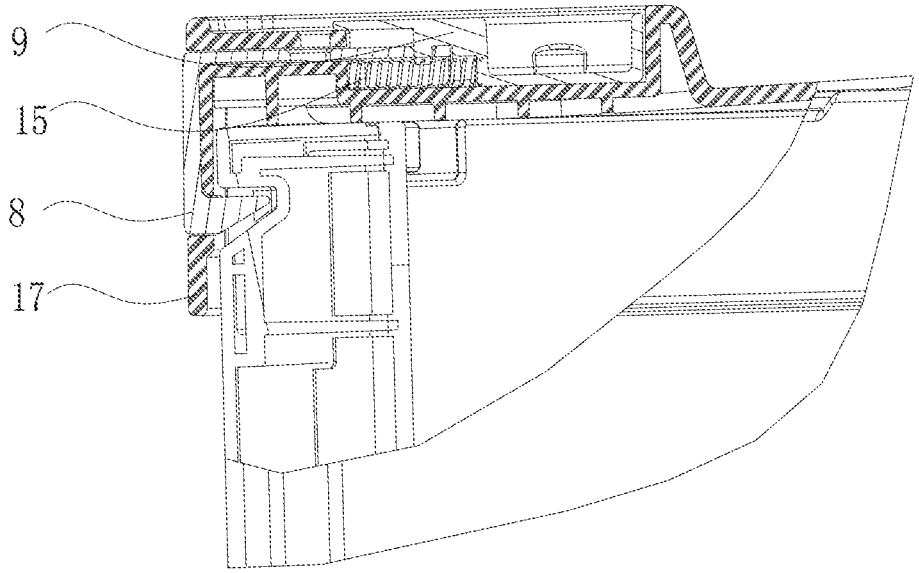
FIG. 16 is a partially enlarged sectional view taken along the line A-A of FIG. 15.

As shown in FIGS. 15-16, each corner of the container 200 is provided with a protrusion 19 protruding upward from the lid 17. That is, a total of four protrusions 19 are provided on the lid 17. All protrusions 19 have the same outer shape and the shape of each protrusion 19 is symmetrical with respect to the corresponding diagonal of the lid. The shape of the protrusion 19 may be an ellipse, the long axis of which coincides with the diagonal of the lid. Of course, the protrusion 19 can also be circular or rectangular, as long as the central axis of the protrusion coincides with the diagonal of the lid and the shape of the protrusion is symmetrical with respect to its central axis. Preferably, the protrusion 19 integrally protrudes upwardly from the lid 17. In another embodiment, the protrusion 19 can also be mounted on the lid as a separate member.

The locking device 16 is mounted in the protrusion 19. The locking tongue member 8 of the locking mounted 16 is mounted such that when unlocking, the moving direction of the locking tongue member 8 relative to the lid coincides with the corresponding diagonal of the lid.

Figure 13:
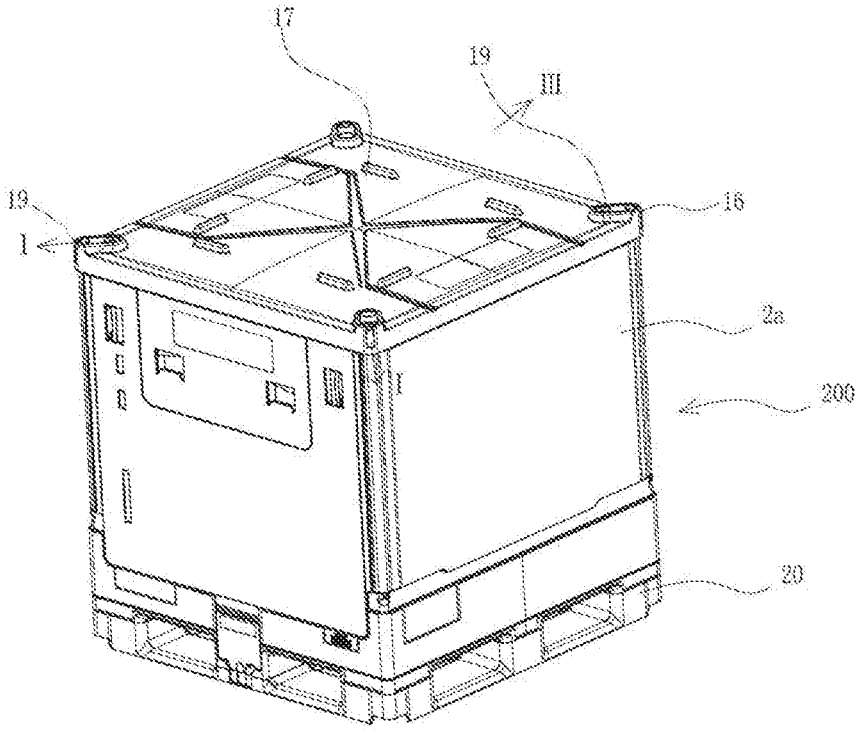
FIG. 13 is a perspective view of a container provided with a locking device according to another embodiment of the present invention.

When unlocking from any side of the lid, the two locking devices on this side are unlocked at the same time, that is, the locking tongues are pulled out along the diagonal direction I of the lid, and then the lid is pushed out in the direction III, so that the lid is unlocked and removed from the side plate, as shown in FIG. 13. When operating on different sides, the possible direction of movement of the locking tongue is shown in FIG. 18.

Figure 14:
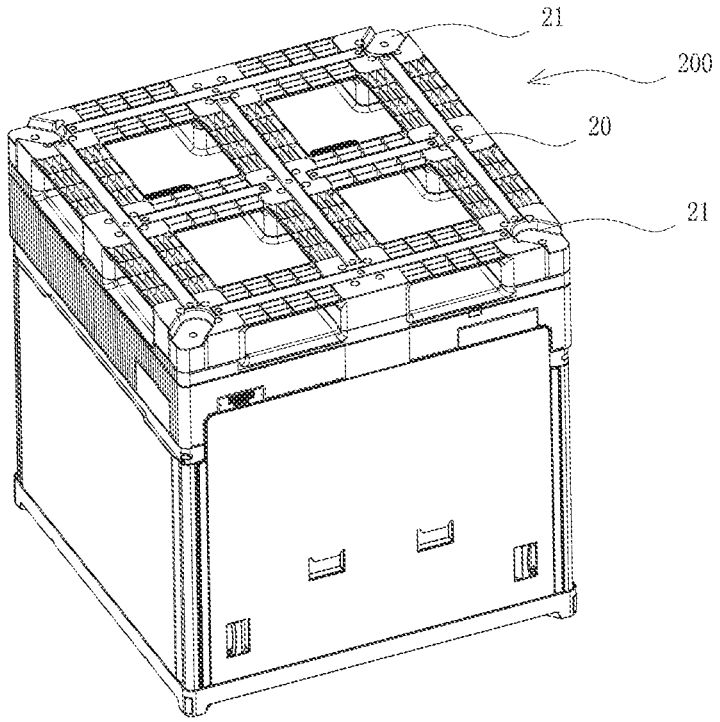
FIG. 14 is another perspective view of the container of FIG. 13, showing the structure of the base.
Figure 19:
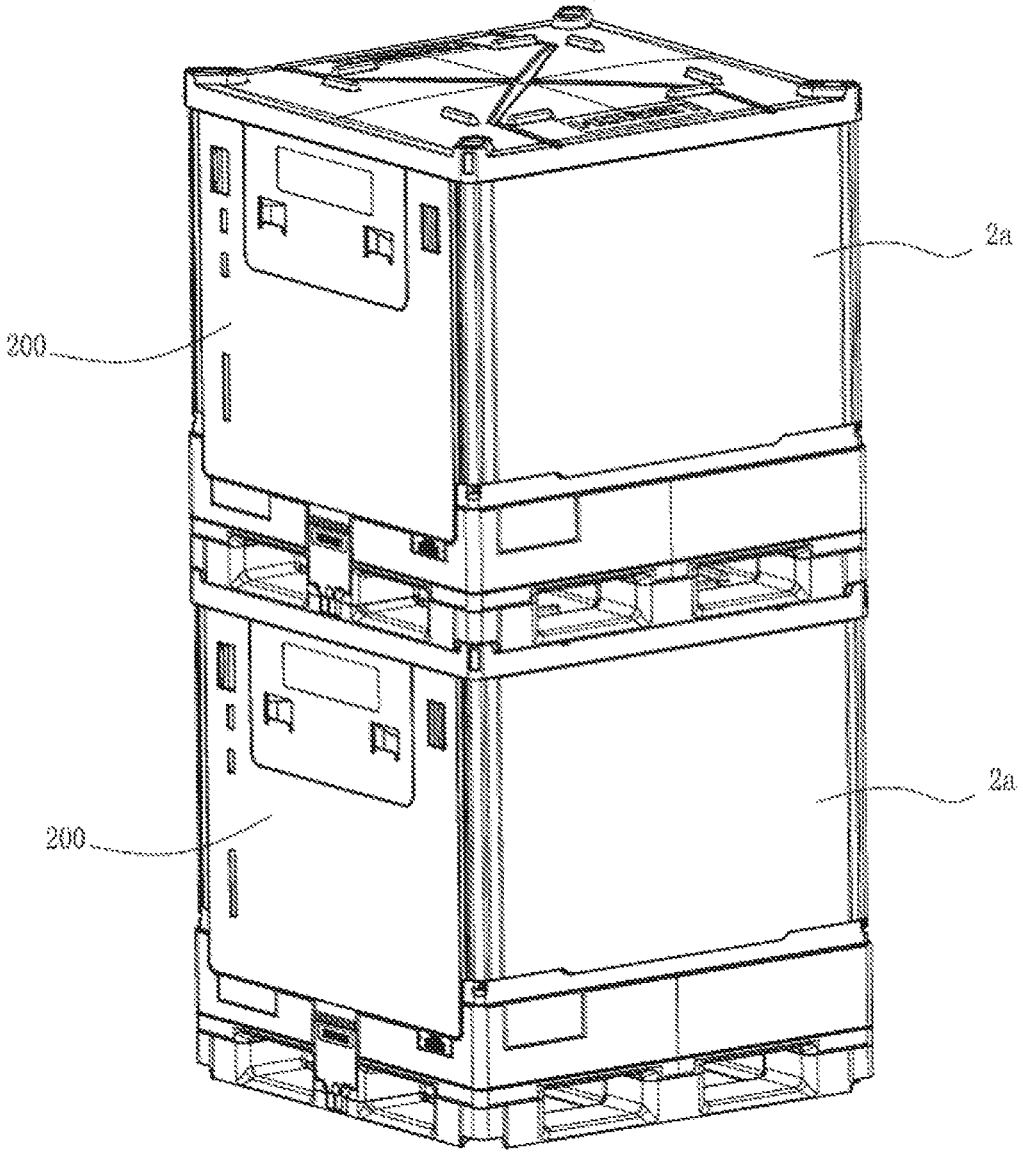
FIG. 19 is a structural diagram of two containers of FIG. 13 stacked on each other.
Figure 20:
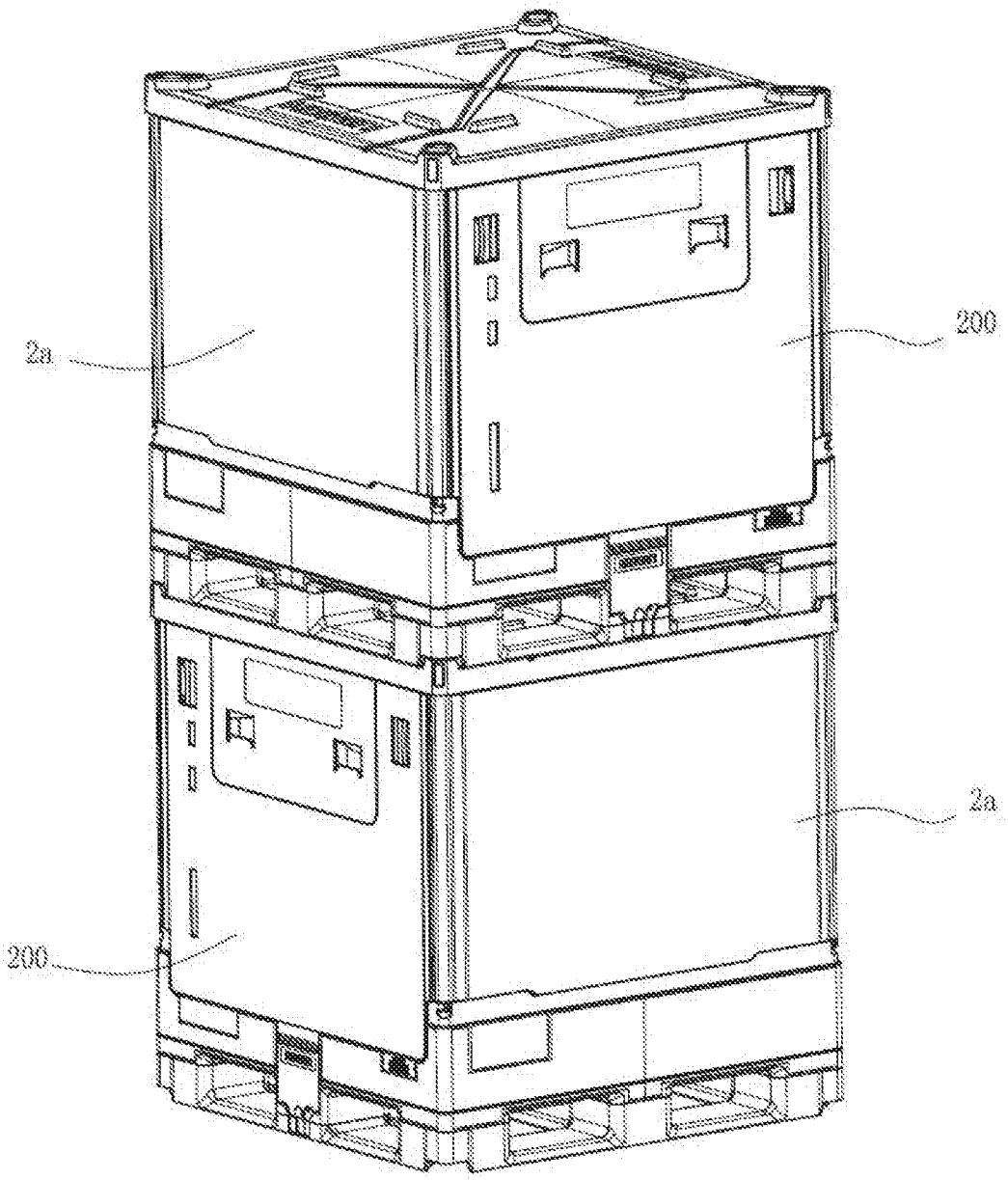
FIG. 20 is another structural diagram of two containers of FIG. 13 stacked on each other, compared with FIG. 19, the upper container is rotated by 90 degrees relative to the lower container.

As shown in FIG. 14, the four corners of the base 20 of the container 200 are provided with pits 21 whose positions and shapes match the positions and shapes of the protrusions 19 respectively. The pits 21 are used to limit the container's position when the containers 200 are stacked on each other. Specifically, when the containers 200 are stacked on each other, the protrusion 19 is placed in the pit 21, thereby positioning the upper container relative to the lower container. Because all protrusions 19 have the same outer shape and the shape of each protrusion 19 is symmetrical with respect to the corresponding diagonal of the lid. Therefore, when the lid of the container is a square lid, it is allowed to buckle the lid and the side plate from any side. When the containers are stacked on each other, it is allowed the upper container to be stacked on the lower container from any side when stacking, as shown in FIG. 19-20.

According to actual use and test data, the closer the locking structure on the lid is to the top corner of the container, the more stable its locking function is. This is because the deformation of the top corner of the container during use is smaller than that of other positions, and the locking effect of the locking structure is also relatively more stable. At the same time, from the view of the lid structure, the strength of the lid against the impact of liquid is the best when the locking structure is close to the four top corners.

The preferred embodiments of the present invention have been described in detail above, but it should be understood that, if necessary, aspects of the embodiments can be modified to adopt aspects, features, and concepts of various patents, applications, and publications to provide additional embodiments.

Considering the detailed description above, these and other changes can be made to the embodiments. Generally speaking, in the claims, the terms used should not be considered as limited to the specific embodiments disclosed in the specification and claims, but should be understood as including all possible embodiments together with all equivalent scope of the claims.

The invention claimed is:

1. A container, comprising:

a base, two pairs of opposed side plates, and a lid, wherein the two pairs of opposed side plates are both connected to the base, and the lid is lockable to a top of the side plates via locking devices, each of four top corners of the container is provided with one of the locking devices, wherein the locking devices includes four locking devices arranged opposite to each other in pairs along a corresponding diagonal of the lid, and each of the locking devices includes one locking tongue member provided on the lid and one locking groove provided on a corresponding side plate of the two pairs of opposed side plates, wherein the locking tongue member has a locking tongue and is arranged to be movable relative to the lid so that the locking tongue is insertable into the locking groove to lock the lid to the corresponding side plate and is detachable from the locking groove to unlock the lid, and each of the locking grooves extends outwardly out of the corresponding side plate along the corresponding diagonal direction of the lid.

2. A container according to claim 1, wherein each corner of the container is provided with one protrusion protruding upwardly from the lid, all the protrusions have the same outer shape and the shape of each protrusion is symmetrical with respect to the corresponding diagonal of the lid, the locking device is mounted in the protrusion, and four corners of the base of the container are provided with pits whose positions and shapes match with the positions and shapes of the protrusions respectively.

3. A container according to claim 2, wherein the protrusion integrally protrudes upwardly from the lid.

4. A container according to claim 1, wherein each of the locking grooves is symmetrical with respect to the corresponding diagonal of the lid.

5. A container according to claim 1, wherein each of the locking devices further has an operating member and a restoring member, wherein the operating member is slidably mounted on the lid and connected to the locking tongue member, and the restoring member is arranged to reset the locking tongue member after releasing the operating member.

6. A container according to claim 5, wherein the locking tongue member has a rod-shaped body, a vertical rod extends downwardly from one end of the rod-shaped body, the locking tongue extends from a distal end of the vertical rod toward the other end of the rod-shaped body in a direction parallel to the rod-shaped body, the rod-shaped body of the locking tongue member is provided with a mounting hole; and the operating member has a plate-shaped body, one end of the plate-shaped body is provided with a recessed operating portion and the other end is provided with side walls extending downwardly on both sides, the a lower edge of the side walls is provided with a guiding rail which is slidably mounted in the lid, and a mounting post extends downwardly from a middle portion of the plate-shaped body, the mounting post is inserted into the mounting hole.

7. A container according to claim 1, wherein the container has a length more than 800 mm, a width more than 600 mm, and a height more than 500 mm.

8. A container, comprising:

a base, two pairs of opposed side plates, and a lid, wherein the two pairs of opposed side plates are both connected to the base, and the lid is lockable to the side plates via locking devices, each of four top corners of the container is provided with one of the locking devices, wherein each of the locking devices include one locking tongue member provided on the lid and one locking groove provided on a corresponding side plate of the two pairs of opposed side plates, wherein the locking tongue member has a locking tongue and is arranged to be movable relative to the lid so that the locking tongue is insertable into the locking groove to lock the lid to the corresponding side plate and is detachable from the locking groove to unlock the lid, and each of two ends of an upper portion of each side plate of one pair of the two pairs of opposite side plates is provided with one of the locking grooves, wherein the locking groove is a recess, one end of the recess is at a predetermined distance from an edge of the corresponding side plate and the other end extends to the edge of the corresponding side plate along a direction parallel to the lid, and unlocking directions of two of the locking devices arranged on the same side of one of the pair of opposite side plates provided with the locking grooves are the same, and the unlocking directions are opposite to unlocking directions of the two of other locking devices arranged on the same side of the other one of the pair of opposite side plates;

each of the locking grooves is configured such that the locking tongue is disengagable from the locking groove along a first direction and a second direction, respectively, wherein said first direction and said second direction are parallel to the two pairs of opposing side plates, respectively; and when the locking devices provided at two top corners of one of the side plates being in an unlocking state, the locking devices provided at two top corners of the other side plate opposite to the one of the side plate are unlocked as the cover is moved toward the other side plate opposite to the one of the side plates.

9. A container according to claim 8, wherein each corner of the container is provided with one protrusion protruding upwardly from the lid, all the protrusions have the same outer shape and the shape of each protrusion is symmetrical with respect to the corresponding diagonal of the lid, the locking device is mounted in the protrusion, and four corners of the base of the container are provided with pits whose positions and shapes match with the positions and shapes of the protrusions respectively.

10. A container according to claim 9, wherein the protrusion integrally protrudes upwardly from the lid.

11. A container according to claim 8, wherein each of the locking devices further has an operating member and a restoring member, wherein the operating member is slidably mounted on the lid and connected to the locking tongue member, and the restoring member is arranged to reset the locking tongue member after releasing the operating member.

12. A container according to claim 11, wherein the locking tongue member has a rod-shaped body, a vertical rod extends downwardly from one end of the rod-shaped body, the locking tongue extends from a distal end of the vertical rod toward the other end of the rod-shaped body in a direction parallel to the rod-shaped body, the rod-shaped body of the locking tongue member is provided with a mounting hole; and the operating member has a plate-shaped body, one end of the plate-shaped body is provided with a recessed operating portion and the other end is provided with side walls extending downwardly on both sides, a lower edge of the side walls is provided with a guiding rail which is slidably mounted in the lid, and a mounting post extends downwardly from a middle portion of the plate-shaped body, the mounting post is inserted into the mounting hole.

13. A container according to claim 8, wherein the container has a length more than 800 mm, a width more than 600 mm, and a height more than 500 mm.

14. A container, comprising:

a base, two pairs of opposed side plates, and a lid, wherein the two pairs of opposed side plates are both connected to the base, and the lid is lockable to the side plates via locking devices, each of four top corners of the container is provided with one of the locking devices, wherein each of the locking devices include one locking tongue member provided on the lid and one locking groove provided on a corresponding side plate of the two pairs of opposed side plates, wherein the locking tongue member has a locking tongue and is arranged to be movable relative to the lid so that the locking tongue is insertable into the locking groove to lock the lid to the corresponding side plate and is detachable from the locking groove to unlock the lid, each of two ends of an upper portion of each side plate of one pair of the two pairs of opposite side plates is provided with one of the locking grooves, the locking grooves are recesses provided on the two ends of the upper portion of the side plate respectively, one end of each of the recesses is at a predetermined distance from an edge of the corresponding side plate and the other end is provided with a guiding slope, and unlocking directions of two of the locking devices arranged on the same side of one of the pair of opposite side plates are the same, and the unlocking directions are opposite to unlocking directions of two of the other locking devices arranged on the same side of the other one of the pair of opposite side plates;

each of the locking grooves is configured such that the locking tongue is disengagable from the locking groove along a first direction and a second direction, respectively, wherein said first direction and said second direction are parallel to the two pairs of opposing side plates, respectively; and when the locking devices provided at two top corners of one of the side plates being in an unlocking state, the locking devices provided at two top corners of the other side plate opposite to the one of the side plate are unlocked as the cover is moved toward the other side plate opposite to the one of the side plates.

15. A container according to claim 14, wherein each corner of the container is provided with one protrusion protruding upwardly from the lid, all the protrusions have the same outer shape and the shape of each protrusion is symmetrical with respect to the corresponding diagonal of the lid, the locking device is mounted in the protrusion, and four corners of the base of the container are provided with pits whose positions and shapes match with the positions and shapes of the protrusions respectively.

16. A container according to claim 15, wherein the protrusion integrally protrudes upwardly from the lid.

17. A container according to claim 14, wherein each of the locking devices further has an operating member and a restoring member, wherein the operating member is slidably mounted on the lid and connected to the locking tongue member, and the restoring member is arranged to reset the locking tongue member after releasing the operating member.

18. A container according to claim 17, wherein the locking tongue member has a rod-shaped body, a vertical rod extends downwardly from one end of the rod-shaped body, the locking tongue extends from a distal end of the vertical rod toward the other end of the rod-shaped body in a direction parallel to the rod-shaped body, the rod-shaped body of the locking tongue member is provided with a mounting hole; and the operating member has a plate-shaped body, one end of the plate-shaped body is provided with a recessed operating portion and the other end is provided with side walls extending downwardly on both sides, a lower edge of the side walls is provided with a guiding rail, which is slidably mounted in the lid, and a mounting post extends downwardly from a middle portion of the plate-shaped body, the mounting post is inserted into the mounting hole.

19. A container according to claim 14, wherein the container has a length more than 800 mm, a width more than 600 mm, and a height more than 500 mm.

* * * * *